US005725330A

United States Patent [19]

Krings

[11] Patent Number: 5,725,330

[45] Date of Patent: Mar. 10, 1998

[54] JOINING ARRANGEMENT

[75] Inventor: Josef Krings, Heinsberg, Germany

[73] Assignee: Wolfgang Richter, Hurtgenwald, Germany

[21] Appl. No.: 656,183

[22] PCT Filed: Oct. 28, 1994

[86] PCT No.: PCT/DE94/01284

§ 371 Date: Jun. 4, 1996

§ 102(e) Date: Jun. 4, 1996

[87] PCT Pub. No.: WO95/16081

PCT Pub. Date: Jun. 15, 1995

[30] Foreign Application Priority Data

Dec. 7, 1993 [DE] Germany ..... 43 41 626.8

[51] Int. Cl.[6] ..... E02D 5/00

[52] U.S. Cl. ..... 405/282; 248/357; 405/283

[58] Field of Search ..... 405/282, 283; 248/357, 351, 354.1

[56] References Cited

U.S. PATENT DOCUMENTS

| | | | |
|---|---|---|---|
| 3,881,679 | 5/1975 | Krings | 405/282 X |
| 4,139,324 | 2/1979 | Drings | 405/282 |
| 5,052,862 | 10/1991 | Uffmann | 248/357 X |
| 5,409,192 | 4/1995 | Oliver | 248/357 X |

FOREIGN PATENT DOCUMENTS

| | | | |
|---|---|---|---|
| 0 054 193 A1 | 5/1982 | European Pat. Off. . | |
| 2 378 155 | 12/1977 | France . | |
| 22 58 588 | 9/1973 | Germany . | |
| 2257881 | 5/1974 | Germany | 405/282 |
| 27 02 750 | 7/1978 | Germany . | |
| 37 11 408 | 10/1988 | Germany . | |
| 39 09 110 C2 | 9/1990 | Germany . | |
| 42 09 675 C1 | 7/1993 | Germany . | |

*Primary Examiner*—Dennis L. Taylor
*Attorney, Agent, or Firm*—Kennedy Covington Lobdell & Hickman, LLP

[57] ABSTRACT

Joining arrangements (7) capable of swivelling around an axis bolt (6) are limited in their swivelling by one of the springs of a pair of springs (12, 13) welded together into a unit to make it possible to individually or alternately drive or pull opposite lining elements (1) of a canal lining system into or out of the soil without causing the braces (4) that prop the lining elements (1) against each other nor their joining arrangements (7) to be deformed.

2 Claims, 5 Drawing Sheets

JOINING ARRANGEMENT

JOINING ARRANGEMENT

Figure 1:
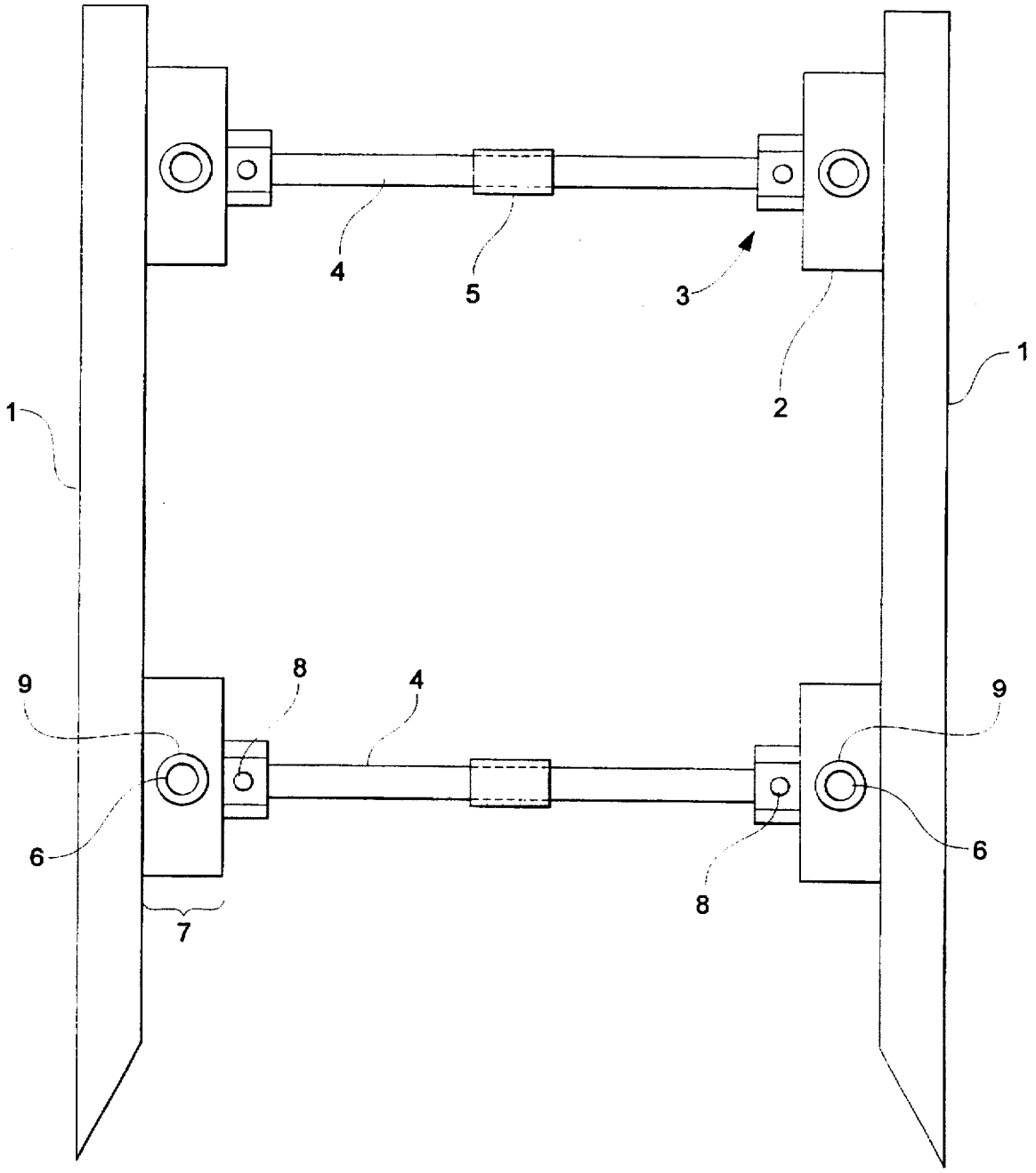

The invention relates to a joining arrangement in accordance with the preamble of claim 1.

A joining arrangement between a guide profile, which is U-shaped in cross section, of a lining element (support or sheeting plate) and a spreader which is held, pivotable around a pivot shaft extending transversely to its longitudinal axis, by means of a support shoe in the guide profile, is known from DE 22 58 588 C1. In this case the support shoe consists of an elongated support plate, whose longitudinal axis is disposed parallel with the longitudinal axis of the guide profile and can be tilted into the guide profile, a receiver for the spreader, disposed on its top, and a drilled-through cylinder piece disposed axially, i.e. transversely to the longitudinal axis of the guide profile, on the underside of the support plate.

In the known reference compression springs are disposed on the underside of the support plate on both sides of the cylinder piece, which during operation are alternatingly pressed against the bottom of the guide profile or the lining element. It is possible in this manner to elastically absorb tilt movements of the spreaders during the alternating lowering (during installation) or lifting (during retreating) of the lining elements. An essential disadvantage of the known arrangement consists in that the springs cannot assure stabilization of the respective spreaders or their fastening in a direction obliquely to the elastically sprung pivot movement, so that undesired tilt movements within the naturally high tolerances in below grade construction—in particular those of the drilled cylinder pieces—cannot be prevented.

With correspondingly high loads, which can always occur in canal construction, it is therefore possible that deformations past the tolerances can occur, both in the joining arrangement as well as the spreaders and in the spindle disposed therein. Furthermore the previous joining arrangements cannot stabilize a pre-assembled lining box in such a way that the box would be standing straight at the site.

In accordance with DE 39 09 110 C2 it is possible in connection with an arrangement in accordance with the above mentioned DE 22 58 588 C1 to embody the guide profile as a box with a U-profile, wherein a bore, which is aligned with the bore of the cylinder piece, leads approximately through the center of the U-shaped legs of the U-profile, and wherein one pair of compression springs each is to be releasably disposed in the guide profile on both sides of the cylinder piece. In this case the tilting moments of the spreader in the direction crosswise to the intended pivot movement cannot be easily controlled.

To address these problems, a joining arrangement is proposed in DE 42 09 675 C1 wherein the support plate on which the spreaders are located is applied between respectively two pairs of extension and compression springs (on both sides of the receptacle). This arrangement is of such a height that its mounting absolutely requires a slit in the respective lining element. A further disadvantage of the known double spring arrangement resides in that the outer springs facing away from the lining element are located on both sides of the receiver for the spreader, so that the latter, if it is deflected too far, bumps against one or the other (outer) spring and can cause damage to the joining arrangement.

It is the object of the invention, based on the joining arrangement in accordance with DE 39 09 110 C2, to improve the device in such a way that simultaneously an increased spring force becomes technically possible, tilting moments of the spreader in the direction transversely to the intended pivot movement can be better absorbed and a flat construction is nevertheless maintained.

The attainment of the object in accordance with the invention will be described in the characterizing part of claim 1. A further development is recited in claim 2.

In accordance with the invention it is provided for the joining arrangement of the type mentioned at the outset that the pair of helical pressure springs consists of springs which, in a top view, are positioned parallel next to each other, that each pair of pressure springs is connected as one part by means of respectively one connecting plate which couples the longitudinal ends of the spring, that the connecting plate facing the support plate has respectively two bores extending into the springs of the pairs of springs, that two pairs of pins, namely each with a pin for insertion in each bore of the connecting plates, in particular as far as the spring located underneath, have been formed on the underside of the support plate, and that during the operation the lower connecting plate facing the lining element is coupled irremovably solidly to the bottom of the guide profile.

By means of the invention it is achieved that the static padding of pivot movements of the joining arrangements or the respective spreader—during installation and retreating of the respective lining elements—is to be absorbed not only by one, but by two springs located next to each other in the axial direction of the pivot movement. The springs are connected in pairs with the aid of connecting plates, preferably welded together, in such a way that they can be mounted as separate pairs in one piece (pair of springs). When applied, they are to be connected, for example hooked together with the bottom of the guide profile, i.e. with the bottom of the U, sufficiently solidly, but releasably, so that they cannot be pulled out of their bracing during operation.

Each of these pairs of springs has, at least on the side facing the guide shoe (in the connecting plate there) continuous bores, through which pins fixedly attached to the underside of the guide shoe, for example welded on, are to be inserted, preferably as far as into the springs. A stabilization of the entire joining arrangement is achieved by means of this additional plug connection even in directions which diverge from the permissible and spring-generated pivot direction around the axis of the cylinder piece. As is customary, the cylinder piece itself is anchored in the guide profile with the aid of a support bolt, which penetrates through the cylinder piece and through bores in the leg of the U-shaped guide profile, which are aligned with the bore of the cylinder piece. The guide profile is solidly connected, as is customary, in the adjacent area of the respective lining element, for example welded or screwed together with it.

Since it is provided in accordance with the invention that the pivot movement of the joining arrangement, or of the spreaders employed in connection therewith, is to be stabilized by respectively one pair of springs connected as a unit to form a compression/extension spring, and since the pins entering into the pairs of springs and formed on the support shoe practically eliminate movements obliquely in respect to the pivot axis, it is also attained by means of the invention that a pre-assembled lining box (consisting of two joining elements with spreaders opened between them) which is made available for installation stands straight and can therefore be easily inserted into a trench with the aid of an excavator without further manipulations.

Figure 2:
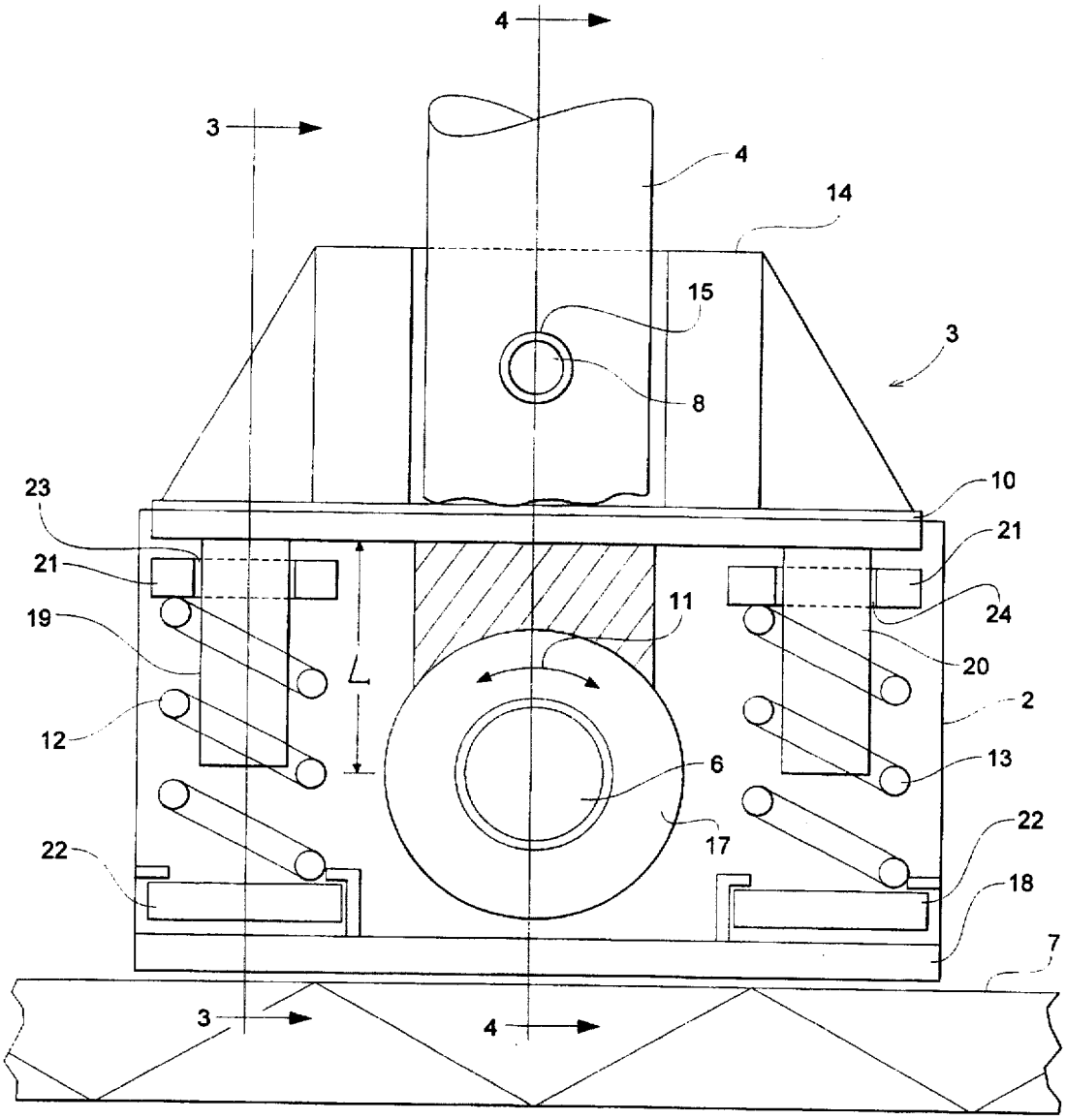
Figure 3:
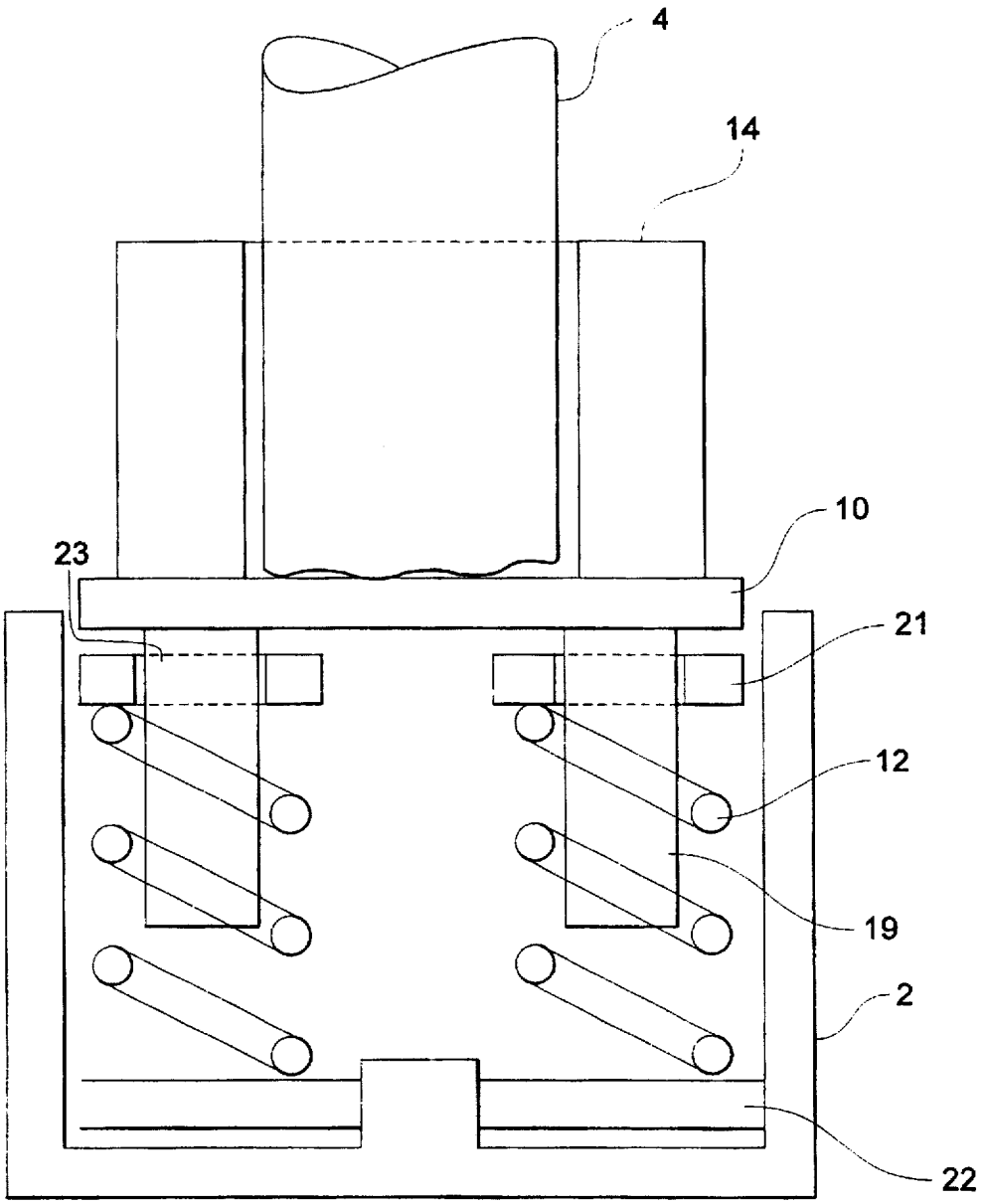
Figure 4:
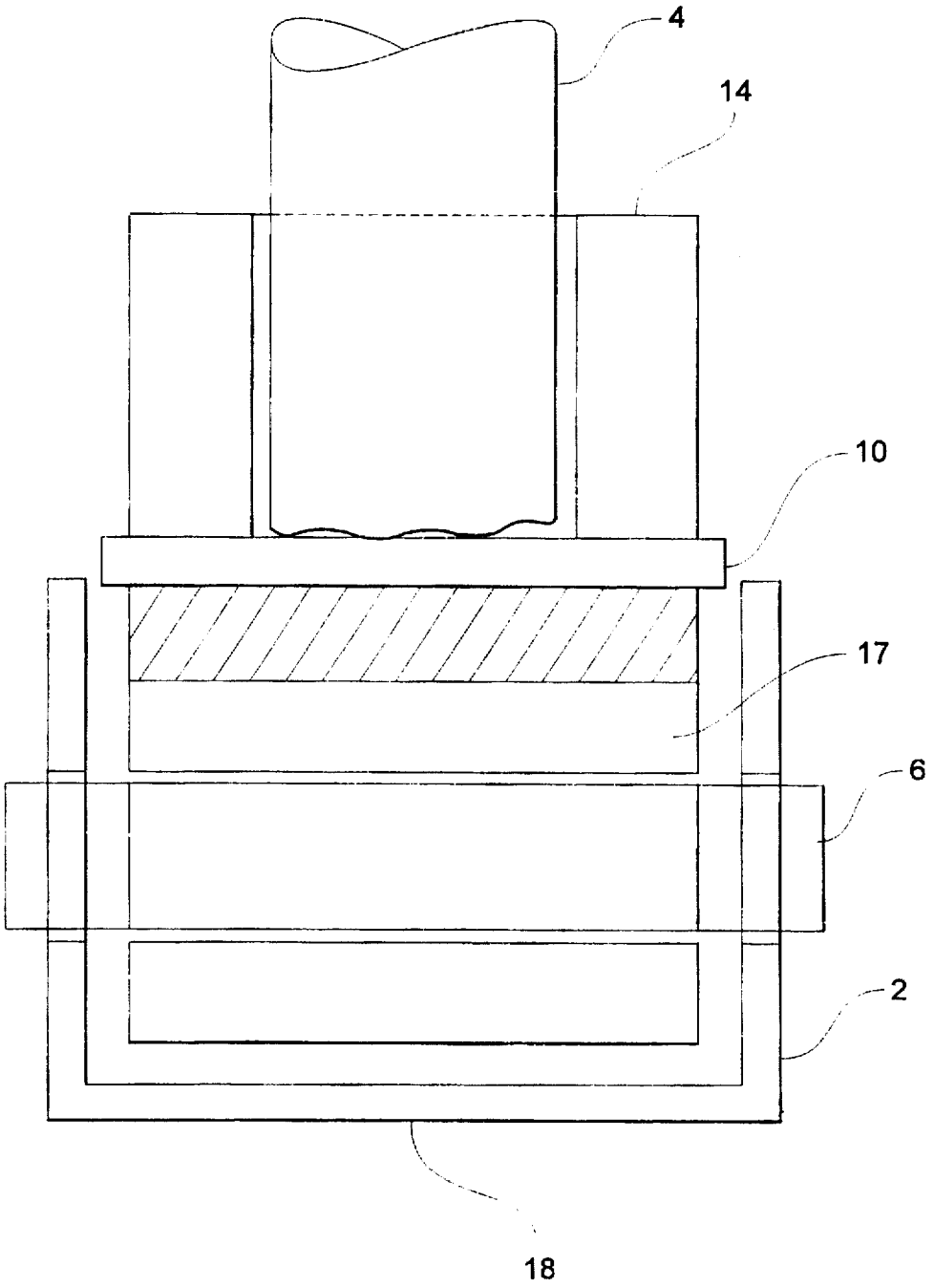
Figure 5:
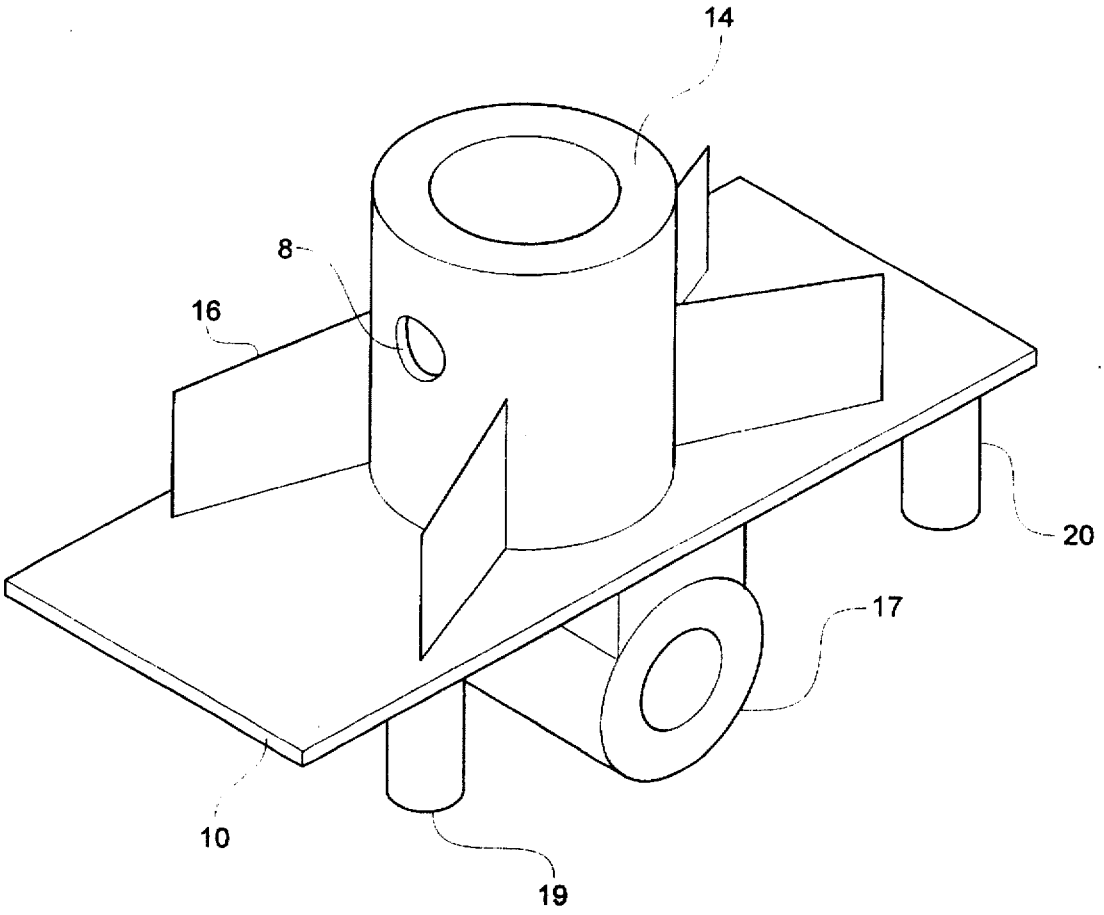

Details of the invention will be explained by means of the schematic representation of an exemplary embodiment. Shown are in:

FIG. 1, a cross sectional view of a lining box prepared for installation;

FIG. 2, a longitudinal section of a joining arrangement in accordance with the invention shown enlarged in comparison with FIG. 1, FIG. 3, a section along the line III—III in FIG. 2;

FIG. 4, a section along the line IV—IV in FIG. 2;

FIG. 5, a perspective view of a guide shoe to be inserted into the guide profile in accordance with FIGS. 2 to 4.

The lining box in accordance with FIG. 1 consists of lining elements 1, for example support or lining plates customary in below grade construction, and guide profiles 2 disposed thereon, having support shoes 3 and spreaders 4 with spindles 5 projecting into them. During the alternating lowering of the lining elements 1 (into the excavated pit), the spreaders 4 can be resiliently tilted upward or downward around a pivot shaft 6.

The spreaders 4 in accordance with the exemplary embodiment are fixed in place in the joining arrangement, identified as a whole by 7, with the aid of support bolts 8. Two or more guide profiles 2 can be arranged above and next to each other on each of the lining elements 1. It is also basically possible for a U-shaped guide profile to extend as one piece from the top to the bottom along the largest portion of a lining element 1. In this case two or more bores 9 for the insertion of pivot shafts 6 or for fixing support shoes 3 in place are provided.

FIGS. 2 to 5 will be explained together. In the exemplary embodiment represented, the support shoe 3 consists of a support plate 10, which can be pivoted around the pivot shaft 6 in the pivot direction 11 into the U-shaped guide profile 2 against the force of the pairs of springs 12 and 13. On the top 4, the support plate 10 facing the spreader 4, has a receiver 14 for inserting the spreader 4. In the exemplary embodiment the receiver 14 has a bore 15 for inserting the support bolt 8, as well as welded-on stiffening plates 16. An inserted spreader 4 is to be fixed in place by means of the support bolt 8.

A cylinder piece 17, which has been drilled through axially, i.e. transversely to the longitudinal axis of the guide profile 2, is attached, in particular welded, to the underside of the support plate 10 facing the lining element 1. This cylinder piece 17 is to be movable around the pivot shaft 6 in the pivot direction 11. Therefore, the cylindrical bore or the like facing the pivot shaft 6 is important, and not so much the exterior shape of the cylinder piece. The face of the cylinder piece 17 facing the bottom of the U-shaped guide profile 2, however, should be shaped in such a way that a contact between the cylinder piece 17 and the bottom of the guide profile 2 cannot take place, even with the greatest conceivable deflections in the pivot direction 11.

In accordance with the invention, the support plate 10 has, besides the cylinder piece 17, two pairs of pins 19 and 20 on its underside which faces the respective lining element, which are embodied and applied in such a way that they enter the four pairs of springs 12, 13 when the support shoe 3 is placed on the U-shaped guide profile 2 equipped with the pairs of springs 12, 13. The length L of the individual pins of the two pairs of pins 19, 20 is preferably preselected in such a way that even under the strongest deflections in the pivot direction 11 the pins cannot come in contact with the bottom 18 of the guide profiles or the like.

In accordance with the invention, each of the pairs of springs 12, 13 is kept together as one piece by means of an upper and a lower connecting plate 21, 22. For example, the springs can be welded to the connecting plates 21, 22. In accordance with the invention, at least the connecting plates 21 which face the support plate 10 have bores 23, 24, through which the pairs of pins 19, 20 project into the respective spring during installation and in operation.

Because of the fact that in accordance with the invention respectively two springs, which are combined into a pair of springs, are provided on both sides of the pivot shaft 6, and whose spring travel, with the same spring force, is essentially greater than that which can be provided with a single spring, that furthermore the two pairs of springs are held together as a unit by means of the connecting plates 21, 22, and that pins 19, 20 which extend through the upper connecting plates 21 project from the support plate 10, it is achieved that no deformation of either the joining arrangement or the spreader can occur, even with the strongest deflections—for reason of stability these are not permitted to exceed more than 10°—, since the spring travel permits correspondingly large pivot angles around the pivot shaft 6. In addition, the combination of connecting plates at the pairs of springs 19, 20 and the pins 19, 20 at the support plate 10 stabilizes the entire joining arrangement in such a way that in case of forces obliquely in respect to the pivot shaft 6, deformations can normally no longer occur, because these forces are not only absorbed by the pivot shaft 6, but also by the combined clamping effect of the springs, connecting plates and pins.

LIST OF REFERENCE NUMERALS

1=Lining element
2=Guide profile
3=Support shoe
4=Spreader
5=Spindle
6=Pivot shaft
7=Joining arrangement
8=Support bolt
9=Bore
10=Support plate
11=Pivot direction
12, 13=Pair of springs
14=Receiver
15=Bore
16=Stiffening plate
17=Cylinder piece
18=Bottom (2)
19, 20=Pair of pins
21, 22=Connecting plate
23, 24=Bore
L=Length of 19, 20

I claim:

1. A joining arrangement between a guide profile (2), which is U-shaped in cross section, of a lining element (1) (support or sheeting plate) and a spreader (4) which is held, pivotable around a pivot shaft (6) extending transversely to its longitudinal axis, by means of a support shoe (3) in the guide profile (2), wherein the support shoe (3) consists of an elongated support plate (10), whose longitudinal axis is disposed parallel with the longitudinal axis of the guide profile (2) and can be tilted into the guide profile, a receiver (14) for the spreader (4), disposed on the top of the support plate (10) facing the spreader (4), and a drilled-through cylinder piece (17) disposed on the underside of the support plate (10) and arranged with its axial bore transversely to the longitudinal axis of the guide profile (2), wherein the guide profile (2) is embodied as a box with a U-profile, respectively one bore (9), which is aligned with the bore of the cylinder piece (17), leads approximately through the center of the U-shaped legs of the U-profile, and one pair of compression springs (12, 13) is releasably disposed in the guide profile (2) on both sides of the cylinder piece (17), characterized in that the pair of helical pressure springs (12, 13) consists of springs which, in a top view, are positioned parallel next to each other, that each pair of pressure springs (12, 13) is connected as one part with respectively two connecting plates (21, 22) which couple the longitudinal ends of the spring, that the connecting plate (21) facing the support plate (10) has respectively two bores (23, 24) extending into the springs of the pairs of springs (12, 13), that two pairs of pins (19, 20), namely a pin each for insertion into each bore (23, 24) of each connecting plate (21), have been formed on the underside of the support plate (10), and that during the operation the lower connecting plate (22) facing the lining element (1) is coupled irremovably solidly to the bottom of the guide profile (2).

2. A joining arrangement in accordance with claim 1, characterized in that the pairs of springs (12, 13), hooked by means of their lower connecting plates (22) secure against tension during operation, are each connected with the bottom (18) of the guide profile (2).

* * * * *